United States Patent [19]

Bellicardi et al.

[11] 4,372,896

[45] Feb. 8, 1983

[54] DEVICE ADAPTED TO CORRECT THE AIR-FUEL RATIO OF THE MIXTURE DELIVERED BY A CARBURETOR DURING THE PERIODS OF OPERATION AT LOW LOADS OF A MOTOR VEHICLE ENGINE

[75] Inventors: Francesco Bellicardi; Renato Vitto, both of Bologna, Italy

[73] Assignee: Weber S.p.A., Bologna, Italy

[21] Appl. No.: 321,407

[22] Filed: Nov. 16, 1981

Related U.S. Application Data

[63] Continuation of Ser. No. 156,803, Jun. 5, 1980, abandoned.

[30] Foreign Application Priority Data

Jun. 8, 1979 [IT] Italy ..... 3432 A/79

[51] Int. Cl.[3] ..... F02M 7/24

[52] U.S. Cl. ..... 261/121 B

[58] Field of Search ..... 261/121 B

[56] References Cited

U.S. PATENT DOCUMENTS

| | | | |
|---|---|---|---|
| 2,094,555 | 9/1937 | Von Hilvety | 261/DIG. 19 |
| 2,214,964 | 9/1940 | Leibing | 261/41 D |
| 2,933,168 | 4/1960 | Leibing et al. | 261/DIG. 19 |
| 3,156,333 | 11/1964 | Barnes | 261/121 B |
| 3,741,188 | 6/1973 | Rickey | 261/121 B |
| 3,795,237 | 3/1974 | Denton | 261/121 B |
| 4,007,721 | 2/1977 | Regueiro | 261/121 B |
| 4,146,594 | 3/1979 | Raud | 261/DIG. 19 |
| 4,146,595 | 3/1979 | Szott et al. | 261/121 B |
| 4,190,028 | 2/1980 | Carlson et al. | 261/121 B |

FOREIGN PATENT DOCUMENTS

| | | | |
|---|---|---|---|
| 2604999 | 8/1976 | Fed. Rep. of Germany | 261/121 B |
| 52-24626 | 2/1977 | Japan | 261/121 B |
| 52-31234 | 3/1977 | Japan | 261/121 B |
| 55-46015 | 3/1980 | Japan | 261/121 B |
| 1205142 | 9/1970 | United Kingdom | 261/121 B |

*Primary Examiner*—Tim R. Miles

*Attorney, Agent, or Firm*—Pearne, Gordon, Sessions, McCoy & Granger

[57] ABSTRACT

A correction device for correcting the air-fuel ratio of the mixture delivered by a carburetor is described; the device comprises a first channel communicating, at one end, with a gasoline delivering circuit and with the atmosphere, respectively, through two conduits, end at the other end, with the intake conduit of the carburetor in a zone located near the rim of the throttle; opening into the said first channel, is a first end of a second channel whose other end communicates with the atmosphere, and along the said second channel there is disposed valve means arranged to interrupt the said communication with the atmosphere in response to the variations of the vacuum in the said intake conduit downstream of the throttle valve of the carburetor.

8 Claims, 1 Drawing Figure

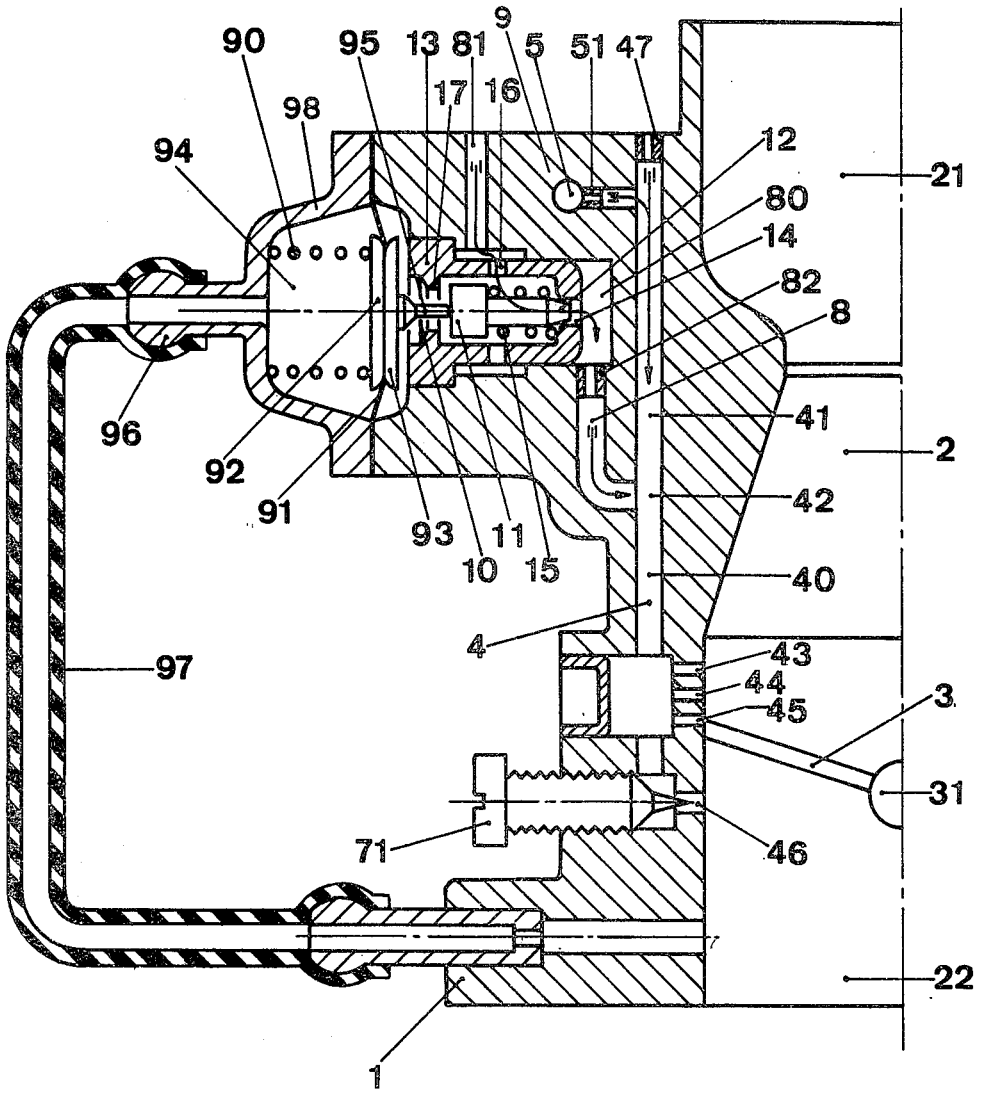
90
95
13
81
9
5
51
47
17
16
98
94
12
21
80
14
82
8
96
41
2
92
91
42
93
11
10
15
40
4
97
43
44
45
3
31
71
46
22
1

DEVICE ADAPTED TO CORRECT THE AIR-FUEL RATIO OF THE MIXTURE DELIVERED BY A CARBURETOR DURING THE PERIODS OF OPERATION AT LOW LOADS OF A MOTOR VEHICLE ENGINE

This is a continuation of application Ser. No. 156,803, filed June 5, 1980, now abandoned.

BACKGROUND OF THE INVENTION

The present invention relates to a device arranged to enrich or lean the mixture from the low speed and progression circuit of a carburetor, in order to adapt the air-fuel ratio of the mixture to the various conditions of operation which concern this circuit exclusively. More particularly, the invention relates to a device which is part of the low speed circuit and affects the quantity of emulsion air, in order to control the air-fuel ratio of the mixture delivered with small openings of the throttle valve.

Devices of this type are known.

To correct the air-fuel ratio of the mixture delivered by the low speed circuit of a carburetor, in order to keep it adapted to the various operation requirements of the engine, it has been proposed to vary the gasoline metering port in a continuous or discrete manner, subjecting such variation to the manifold vacuum in the exhaust conduits downstream of the throttle valve.

When choosing to carry out the correction of the air-fuel ratio by acting on the gasoline, considerable expenses have to be met for machining the metering parts which have to be of very high precision. In fact, an error in the dimensions of such a jet gives rise to a difference in the air-fuel ratio of mixture which difference is up to 15 times greater than the difference in the same air-fuel ratio which derives from an error of the same order in the dimensions of a jet which meters the air.

SUMMARY OF THE INVENTION

The present invention resolves this problem by the provision of metering device for metering the emulsion air, which device is highly precise in its operation and economical in its construction and performs the said correction of the air-fuel ratio of the mixture in the periods in which the throttle valve of the carburetor is very near to the closed position.

According to the present invention there is provided a correction device for correcting the air-fuel ratio of the mixture delivered by a carburetor in particular in the periods of operation at low loads of a motor vehicle engine, comprising a first channel formed in the body of the carburetor, which channel communicates, at one end, with a fuel delivering circuit and with the atmosphere, respectively, through two conduits having each a passage bore of pre-established cross-section, and at the other end, through a plurality of bores, with the intake conduit of the carburetor in a zone located near the rim of the throttle, characterized in that opening into the said first channel, in an intermediate point between the said ends, is a first end of a second channel whose other end communicates with the atmosphere, the said second channel being apt to supply air to the said first channel and being provided with a bore of pre-established cross-section arranged to meter the air supplied to the said first channel, along the said second channel there being disposed valve means arranged to interrupt the said communication with the atmosphere in response to the variations of the vacuum in the said intake conduit downstream of the throttle valve of the carburetor.

BRIEF DESCRIPTION OF THE DRAWINGS

These and other objects, advantages and characteristics of the present invention will be more clearly apparent from the following detailed description of a preferred embodiment shown by way of non limiting example in the accompanying single FIGURE of the drawing.

DETAILED DESCRIPTION OF THE INVENTION

As shown in the said drawing, a carburetor 1 for internal combustion engines has a conduit 2, divided into two half conduits 21 and 22 by the throttle valve 3 which rotates about the shaft 31. Opening into the half conduit 21 is the main fuel supply circuit, not shown, because it is of conventional type and does not concern the subject of the present description.

The carburetor comprises also a channel 4 which, at its upper portion, communicates with the fuel supply circuit 5 through a calibrated neck member 51 and with the atmosphere through a calibrated bushing 47. Circuit 5 is a conventional fuel conduit which originates from the bowl or the fuel chamber of the carburetor, which are not shown because they are of the conventional type. An emulsion or primary mixture of gasoline and air passes in the section 41 of the channel 4; in the case of small opening of the throttle 3 this section 41 behaves as the conventional low speed channel.

In the lower portion the channel 4 communicates with the conduit 2 through a plurality of bores 43, 44, 45 and 46. Bore 46, whose passage cross-section is adjusted by the cone-shaped end of the screw 71, is always located downstream of the throttle 3; the bores 43, 44 and 45, which are the normal progression bores, are all, or part of them, located upstream or downstream of the throttle 3, depending on the angular position of this throttle.

The present invention is concerned only with the small openings of the throttle 3, for which the main feed circuit of the internal combustion engine is not involved. These small openings allow locating all the progression bores, or part of them, downstream of the throttle 3.

Opening into a zone 42, intermediate between the upper end and the lower end of channel 4, is a second channel 8 which communicates with the atmosphere through the filter (not shown) and the inlet 81 and in which a calibrated neck member 82 meters the air which passes through the channel 8. Located between the inlet 81 and the neck member 82 is a valve 9, which is apt to shut-off the flow of air which descends from the inlet 81 towards the channel 4 passing through the channel 8.

Independently from how the air is shut-off by the valve 9, we may note that the mixture delivered by the carburetor 1, in case of small openings of the throttle 3, has a tendency toward a leaner air-fuel ratio when the flow of air which traverses the channel 8 is not shut-off by the valve 9, and has a tendency toward a richer air-fuel ratio when the said flow is shut-off by the valve 9. On the other hand, the engine receiving the fuel from the carburetor 1 requires a leaner mixture during the periods of stabilized operation, and requires a tendency toward a richer mixture during the transient periods, i.e. during the accelerations, which take place after small but rapid openings of the throttle or after a small but rapid variation of the load applied onto the engine.

Since during the periods of stabilized operation the manifold vacuum in the conduit 22 is substantially very high and stable and, conversely, during the transient periods of the type mentioned above, the vacuum is considerably lower and unstable, the valve 9 interrupts the flow of air when the said vacuum is substantially low and allows the passage of the air when the vacuum is higher. In this way, the valve 9 corresponds to the requirements of the engine.

For these purposes the valve 9 is a pneumatically operating valve whose member responsive to the vacuum is formed by the membrane 91 having rigidly connected thereto two discs 92 and 93 which stiffen it in its central portion.

On the left of the membrane 91 there is a chamber 94, formed by a cup-shaped element 98, which communicates with the conduit 22, downstream of the throttle 3, by means of a pipe 97 which is applied onto the pipe 96. Therefore, the vacuum in the chamber 94 is equal to that of the conduit 22.

Disposed in the chamber 94 is a spring 90 which exerts a pressure onto the disc 92 in order to push to the right, with a pre-established load, the membrane 91 and the associated members.

Disc 93 is rigidly connected to a pin 95 whose right-hand end exerts a pressure against a shutter member 11 arranged to move into the cylindrical cavity 10 of a valve member 13. This valve member 13 is inserted into a cavity 80 located between the inlet 81 and the calibrated neck 82 of the channel 8.

A plurality of bores 16 connect the inlet 81 of the conduit 8 to the cylindrical cavity 10 of the valve member 13. A bore 14 connects the cylindrical cavity 10 to the calibrated neck 82 of the channel 8.

Shutter 11 has a trunco-conical end 12 which is adapted to close the bore 14. When the bore 14 is closed, there is no flow of air in the channel 8 because of the seal between the walls of the cavity 80 and the outer surface of the valve member 13.

A spring 15 urges the shutter 11 towards the left hand side with a force which is much smaller than the force of the spring 90, transmitted by the pin 95; the force of the spring 15 is sufficient to move away the shutter 11 from the bore 14, when, under the action of the vacuum acting in the chamber 94, the membrane 91 urges the spring 90 to the left hand side and, moving in the same direction, allows element 11 to move. A shoulder 17 determines the end of this movement.

When the cone-shaped end 12 of the shutter 11 is distant from the bore 14, the air coming from the inlet 81 traverses bores 16, bore 14, bushing 82, channel 8 and, in the channel 10, mixes with the emulsion air/-gasoline from the channel 14. A more diluted mixture is formed which, when reaching the bores 43, 44 and 45, or part of them and the bore 46, enters conduit 22 in which it mixes with air entering through the rim of the throttle 3, thus forming the feeding mixture for the engine. In these conditions the mixture delivered by the carburetor is relatively lean.

Conversely, when the cone-shaped end 12 of the shutter 11 closes the bore 14, under the thrust of the spring 90 transmitted by the pin 95, the flow of air from the inlet 81, which air, through the aforementioned path, reaches the channel 40, is interrupted; the mixture delivered by the carburetor becomes relatively rich. The first case, i.e. the case in which the cone-shaped end 12 does not close the bore 14, takes place when the vacuum is relatively high.

In fact, if the vacuum in the conduit 22 is high, since a vacuum of equal value is established in the chamber 94, membrane 91, urged by the pressure forces acting on its surface, is displaced to the left, against the force of the spring 90. Pin 95 disengages the element 11 which, moved to the left by the spring 15, moves the end 12 away from the bore 14, thus allowing the flow of air from the inlet 81 to the zone 42 between the channels 4 and 8 and farther, as specified above.

Analogously, if the vacuum in the conduit 22 is sufficiently low, the pressure force acting on the membrane 91 is not sufficient to overcome the force exerted by the spring 90, so that the closure member 11 is maintained on the right hand side and its end 12 closes the bore 14, thus discontinuing the flow of air through the aforementioned path.

As already said before, the value of the vacuum depends on the use and load conditions of the engine fed by the carburetor 1.

For example, when the throttle valve 3 is subjected to a small but rapid opening, the vacuum in the conduit 2 decreases; valve 9 takes advantage of this situation for discontinuing the flow of additional air through the channel 8. The mixture becomes rich both because there is a decrease of the flow of the emulsion air, which now comes only from the bushing 47, and because there is an increase of the flow of gasoline due to the fact that the vacuum acting onto the delivery system 5 is not reduced by additional discharges of air. This allows a correct operation of the engine, which, during the periods of acceleration, requires a relatively rich mixture. After the end of the transient, the vacuum in the conduit 22 assumes again sufficiently high values and the valve 9 enables again the passage of supplementary emulsion air.

The vacuum in the conduit 22 may decrease even if, with a constant opening of the throttle valve 3, the load applied onto the engine increases; this takes place when the vehicle goes up a short and light climb which does not require a change of the gears or a very different output value of the engine.

In both cases, the requirement of a richer mixture is satisfied by means of the device according to the present invention, which device, by preventing the air from flowing through the channel 8, allows obtaining in the conduit 22 a mixture adapted to the particular conditions of use of the engine.

What has been described hereinabove is only one, non limiting, aspect of the present invention; the materials, shapes and dimensions may be varied in many ways.

We claim:

1. A correction device for correcting the air-fuel ratio of the mixture delivered by a carburetor in particular in the periods of operation at low loads of the motor vehicle engine, comprising a first channel formed in the body of the carburetor, which channel communicates, at one end, with a fuel delivering circuit and with the atmosphere, respectively, through two conduits having each a passage bore of pre-established cross-section, and at the other end, through a plurality of bores, with the intake conduit of the carburetor in a zone located near the rim of the throttle, characterized in that opening into the said first channel, in a position downstream of the outlet of said fuel delivering circuit, is a first end of a second channel formed in the body of the carburetor, the said second channel being provided with a bore of pre-established cross-section arranged to meter a flow of secondary air supplied to the said first channel, at the other end of the said second channel, upstream of said bore therein of pre-established cross section, there being disposed a cavity formed in the body of the carburetor and closed by a cover fixed thereon, a device to close said second channel being disposed inside said cavity, said device comprising a bushing coaxial with said cavity and housed therein having a plurality of radial holes communicating with the atmosphere and an axial hole communicating with said second channel, a needle valve floating inside said bushing and adapted to close said axial hole against the action of a spring housed inside the bushing, and means to urge said needle valve in response to the variations of the vacuum in the said intake conduit downstream of the throttle valve of the carburetor.

2. A device as claimed in claim 1, characterized in that the said valve means comprise a bushing disposed in the said first chamber, provided with at least a radial bore and at least an axial bore, each of which bores is arranged to connect an inner cavity of the said bushing to the said second channel, a shutter member movable axially in the said cavity of the bushing and adapted to control the passage opening through the said axial bore of the bushing and a deformable membrane interposed between the said first chamber and a second chamber which communicates with the said zone of the said intake conduit, the said shutter member being pushed, on one side, by a spring disposed within the said cavity of the bushing, and on the other side by a stem rigidly connected to the said deformable membrane.

3. A device as claimed in claim 2, characterized in that rigidly connected to the said deformable membrane is a disc from one side of which the said stem protrudes, and on the other side of the said disc another spring is disposed in the said second channel and adapted to push the said stem towards the said shutter member.

4. A correction device as claimed in claim 2, wherein said spring housed inside the bushing is displaced between one end of the bushing and the opposite end of the said shutter, coaxial with this latter, a shoulder for said spring being provided on the opposite end of said shutter.

5. A correction device as claimed in claim 1, wherein said means to urge said needle valve are diaphragm means.

6. A correction device as claimed in claim 5, wherein said diaphragm means comprise a vacuum motor comprising an elastic and deformable membrane pinched between said cover and body of the carburetor, said membrane subdividing said cavity into two chambers, a first of which communicates with the atmosphere and a second of which communicates with said zone of the intake conduit by means of a tube, and a pin abutted against said needle valve.

7. A correction device as claimed in claim 6, wherein said pin is rigidly connected to the said deformable membrane by means of a pair of discs, a spring being provided in said second chamber to push said membrane, on one of the said discs, towards said first chamber.

8. A correction device as claimed in claim 7, wherein said pin is adapted to urge one end of said needle valve to push it towards said axial hole.

* * * * *